United States Patent [19]

Pharaoh

[11] Patent Number: 4,912,455

[45] Date of Patent: Mar. 27, 1990

[54] ALARM SYSTEMS

[75] Inventor: Peter L. G. Pharaoh, Broadstone, United Kingdom

[73] Assignee: Weyrad (Electronics) Limited, Weymouth, United Kingdom

[21] Appl. No.: 208,359

[22] PCT Filed: Dec. 17, 1986

[86] PCT No.: PCT/GB86/00772

§ 371 Date: Jun. 17, 1988

§ 102(e) Date: Jun. 17, 1988

[87] PCT Pub. No.: WO87/03985

PCT Pub. Date: Jul. 2, 1987

[30] Foreign Application Priority Data

Dec. 17, 1985 [GB] United Kingdom ..... 8531002

[51] Int. Cl.[4] ..... G08B 13/00

[52] U.S. Cl. ..... 340/541; 340/565; 340/566; 340/511; 340/683; 340/429

[58] Field of Search ..... 340/541, 565, 566, 511, 340/669, 683, 429

[56] References Cited

U.S. PATENT DOCUMENTS

| | | | |
|---|---|---|---|
| 3,133,276 | 5/1964 | Miller et al. . | |
| 3,733,598 | 5/1973 | Kato . | |
| 3,909,826 | 9/1975 | Schildmeier et al. . | |
| 4,333,093 | 6/1982 | Raber | 340/566 |

FOREIGN PATENT DOCUMENTS

| | | |
|---|---|---|
| 1096133 | 12/1967 | United Kingdom . |
| 2023318 | 12/1979 | United Kingdom . |

*Primary Examiner*—Donnie L. Crosland

*Attorney, Agent, or Firm*—Young & Thompson

[57] ABSTRACT

A detector for an alarm system receives a disturbance signal and transmits an alarm signal to a remote station. A group of such detectors can be connected in circuit to operate a common alarm. The detector has means (6, 26, 33) for suppressing a first disturbance signal so that only a second and subsequent ones trigger the alarm. There are also means (8, 30) whereby a disturbance signal only of a given length can pass to trigger the alarm. With another facility (38, 43) the detector registers whether it is the first or a subsequent one in a group to be disturbed. The detector is largely embodied on a integrated circuit chip and all these facilities are selectable by making or omitting simple pin connections.

6 Claims, 1 Drawing Sheet

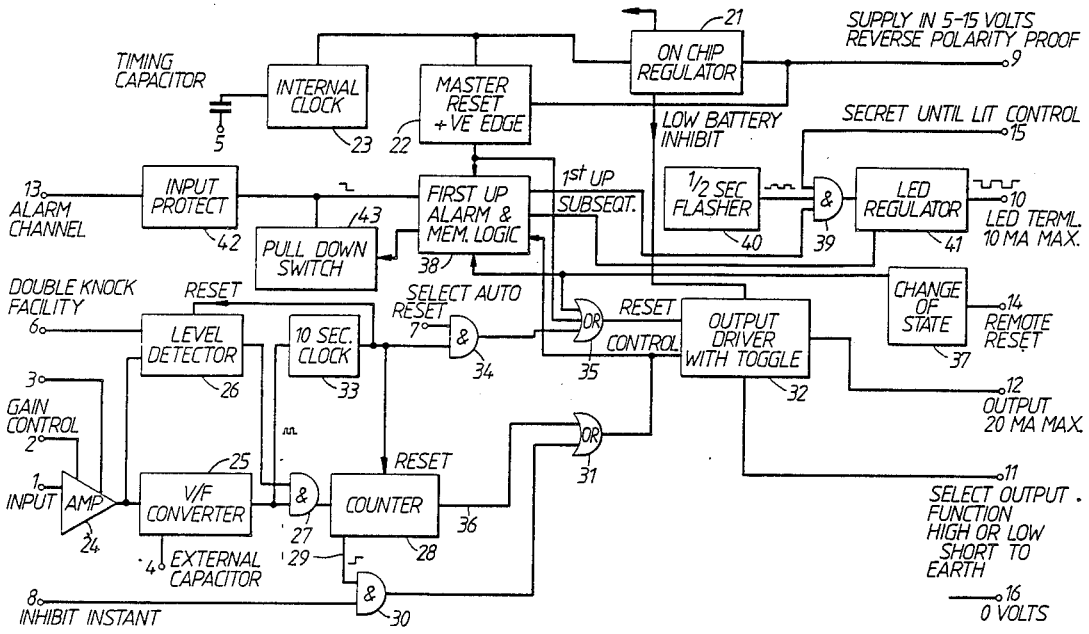

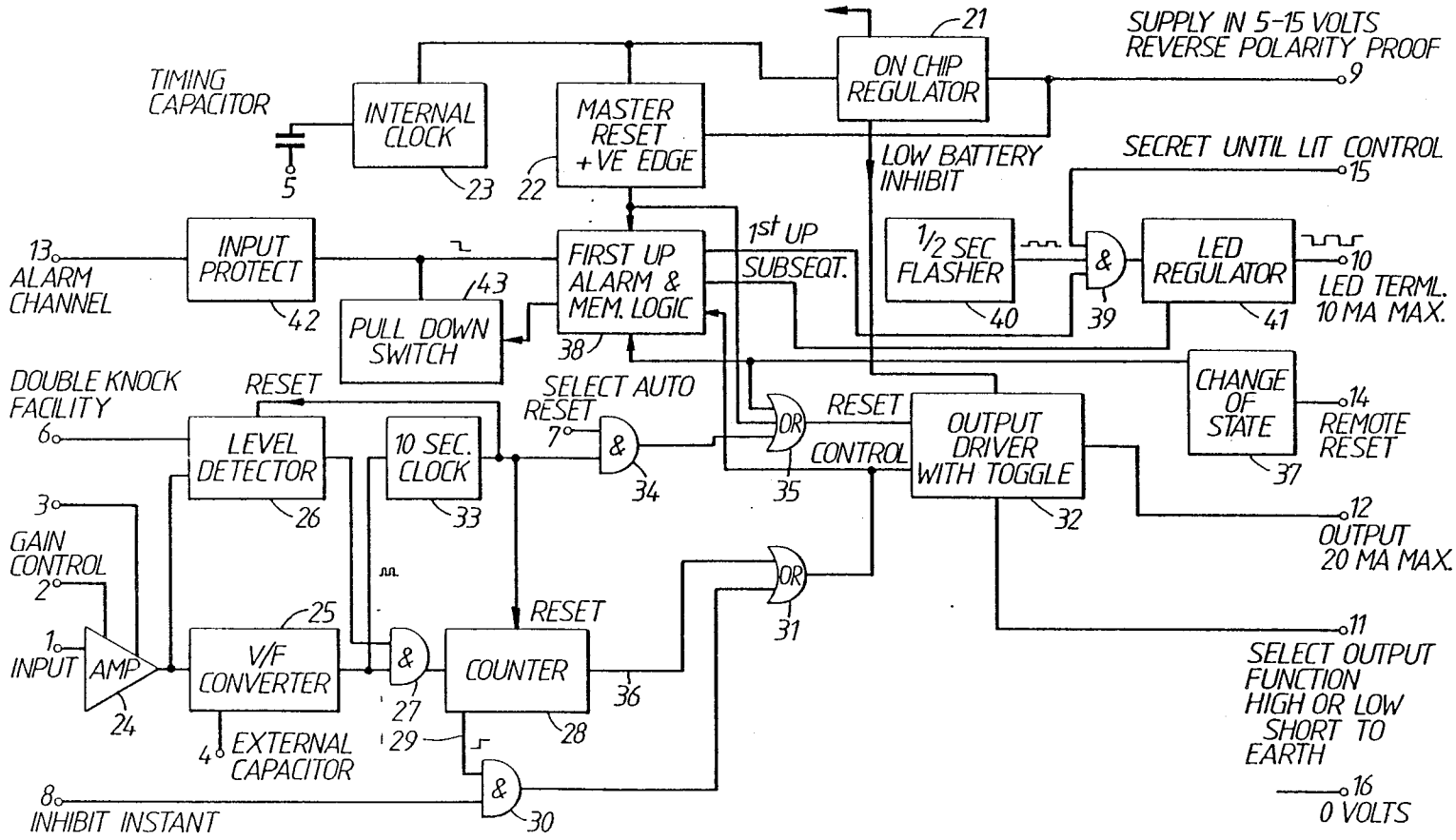
SUPPLY IN 5-15 VOLTS REVERSE POLARITY PROOF
9
SECRET UNTIL LIT CONTROL
15
LED TERML. 10 MA MAX.
10
REMOTE RESET
14
OUTPUT 20 MA MAX.
12
SELECT OUTPUT FUNCTION HIGH OR LOW SHORT TO EARTH
11
0 VOLTS
16
21
ON CHIP REGULATOR
LOW BATTERY INHIBIT
LED REGULATOR
41
39
CHANGE OF STATE
37
1/2 SEC FLASHER
40
OUTPUT DRIVER WITH TOGGLE
32
RESET
CONTROL
1st UP
SUBSEQT.
OR
35
OR
31
MASTER RESET +VE EDGE
22
FIRST UP ALARM & MEM. LOGIC
38
SELECT AUTO RESET
7
34
36
RESET
COUNTER
28
30
INTERNAL CLOCK
23
43
PULL DOWN SWITCH
10 SEC. CLOCK
33
27
29
5
TIMING CAPACITOR
INPUT PROTECT
42
RESET
LEVEL DETECTOR
26
25
V/F CONVERTER
4
EXTERNAL CAPACITOR
13
ALARM CHANNEL
DOUBLE KNOCK FACILITY
6
3
GAIN CONTROL
2
1
INPUT
AMP
24
8
INHIBIT INSTANT

ALARM SYSTEMS

FIELD OF THE INVENTION

This invention relates to alarm systems. It is a development of that described in European Pat. No. 0044725 and is primarily concerned with the local detector units which are distributed over the zone to be protected and wired back to a central control panel.

BACKGROUND OF THE INVENTION

It is important that such units be small and unobtrusive and highly reliable. It is also desirable that there should be certain operational options available, which could be factory-set or made field selectable.

One particular problem is premature triggering of an alarm. With a delicately set detector sensitive to vibrations, for example, a single shake such as may be occasioned by a passing lorry rattling a window may set it off. If an intruder was attempting entry, the disturbance would be more prolonged and repeated. It is therefore desirable to distinguish between the two types of disturbance.

It is also useful to know, when investigating a disturbance to know which of a group of detectors was excited first, but without a complex wiring arrangement back to the central control.

While the invention is designed primarily to be used in conjunction with a vibration sensitive element, there is no reason why its principles should not be applied to the processing of a disturbance signal generated by other means, such as interference of a light beam or contact with a pressure pad.

SUMMARY OF THE INVENTION

According to one aspect of the present invention there is provided a detector for an alarm system in which an intruder generated disturbance signal is transmitted by the detector as an alarm signal to a remote station, wherein the detector has means for suppressing the transmission on a first disturbance by an intruder and for allowing such transmission on a subsequent disturbance.

Means may be provided for gating the disturbance signal through when it attains a predetermined level, the suppressing means then being arranged normally to close the gate but open at a predetermined time after an initial disturbance signal.

In the preferred form, the suppressing means includes a clock, a level detector to which the disturbance signals are applied and means normally holding the level detector in a state such that its output closes the gate but which is nullified a set time after the clock has registered the disturbance signal. Thus, further disturbance signals after attaining a set predetermined level open the gate.

Preferably, the disturbance signal will be formed into a pulse train before application to the gate and the clock. A counter will then receive the gated pulse train and provide an alarm signal trigger, but only after a given number of pulses. This will suppress noise. The clock will be arranged to reset the counter after said set time.

There are selectable means for blocking the alarm signal trigger, the counter being arranged to deliver an alternative alarm signal trigger after a greater given number of pulses. By selecting this feature, a substantially delayed alarm may be generated.

Preferably, means for generating the alarm signal from the disturbance signal will remain activated unless reset, even when the disturbance signal has ceased. However, there may be a selectable reset facility for the alarm generating means which will use the clock output after said set time. Thus, the alarm signal will automatically be cut off at that point.

Conveniently, there will also be facility for resetting the alarm generating means by remote control. This may be adapted to respond to any change of state on a remote control line, but advantageously it will incorporate a delay whereby transient signals are suppressed.

Another selectable resetting facility for the alarm generating means is provided by means responsive to the supply or restoration of power to the detector. The latter may be arranged, as is conventional, to trigger the alarm if the power is cut off and it is convenient that as soon as power is restored no special measures need be taken to shut down the alarm.

Preferably, the suppressing means will be a disconnectable facility, enabling the detector to be responsive to the first disturbance.

According to another aspect of the present invention there is provided an alarm system in which an intruder generated disturbance signal is transmitted by the detector as an alarm signal to a remote station, the detector being adapted to be connected in circuit with similar detectors to a common remote alarm, wherein the detector has means for registering a local disturbance signal, for signalling this to other detectors, and for registering the disturbance correspondingly signalled from another detector.

Preferably, the detector will have means for indicating that it is transmitting an alarm signal, and the registering means may then govern these indicating means so that, if the detector is the first of a connected group to be disturbed, the indication is different from that generated when the detector is disturbed but is not the first of its group.

Conveniently, there will be a selectable facility for inhibiting such indications from a remote station.

BRIEF DESCRIPTION OF THE DRAWING

For a better understanding of the invention, one embodiment will now be described, by way of example, with reference to the accompanying drawing, in which the single FIGURE is a block diagram of an integrated circuit chip for a vibration detector in an alarm system.

DETAILED DESCRIPTION OF THE INVENTION

The chip has 16 terminals or pins, referenced 1 to 16, whose functions, to be described more fully below, are briefly indicated in the FIGURE. The numbering corresponds to actual pin numbers on the chip as it will be manufactured. The various components of the integrated circuit are shown in block form, also with brief identification, and their main interconnections are illustrated and will not be described in detail. Several AND and OR gates are shown in conventional form.

This chip will be part of a small detector unit having a piezo electric crystal, whose vibrations will produce a signal for triggering a remote alarm through this circuit. The unit will also have a light emitting diode (LED), which will indicate locally when such an alarm is activated, and sundry small components, mostly resistors and capacitors, as will be apparent from the following. These items are not shown.

The circuit is powered through pin 9 with DC normally of 12 volts, although in certain applications other levels may be adopted. Pin 16 is at earth or zero volts, and its connections to the various components are not shown for clarity. The supply may be smoothed by an external RC circuit and have reverse polarity protection.

The supply is fed to a regulator 21 and to a master reset circuit 22, and also drives an internal clock 23. The functions of these will be described later or, particularly in the case of the clock, will be self-evident.

The input from the crystal is to pin 1 and thence to an analog amplifier 24 which preferably should exhibit similar noise rejection and signal input characteristics to those of the Texas TL271, for example. This amplifier is subject to gain control through pins 2 and 3, which will be connected to a potential divider whose setting is adjustable on installation or later to the required sensitivity. There will be sufficient series resistance to ensure that the amplifier will exhibit a defined gain even when the potential divider is at its minimum setting. This will ensure that the unit cannot be turned off completely.

The output of the amplifier is directed to a voltage-frequency converter 25 and also to a level detector 26 with a pre-set threshold. An RC network external of the chip is connected to the pin 4 to set the conversion characteristic, the output of the converter being a series of pulses dependent on the input voltage. The level detector 26 opens the AND gate 27 when the threshold is exceeded, and so the pulses are applied to the counter 28 which, after a given small number of pulses, produces an output at 29 to AND-gate 30. In a first mode of operation, for instant detection, the pin 8 is in a state such that the gate 30 is open and so the output passes through OR-gate 31 to the output driver 32. When set, this produces an output at pin 12, which will be fed to the remote alarm. In this mode there is therefore virtual immediate triggering of the alarm once the input signal attains the pre-set threshold selected by the gain control at pins 2 and 3. However, a very brief time delay is imposed by the counter 28 to provide noise immunity from the detector amplifier. The pulses from the converter 25 also activate the clock 33 which, after a delay of up to 10 seconds, resets the counter 28, the level detector 26 and, if the AND-gate 34 is open, the output driver 32 via the OR-gate 35.

In another mode of operation, the terminal 8 is taken high. This will close the gate 30 and block the counter output 29. However, the counter still receives pulses generated from an excited crystal, and when a predetermined number is reached, much larger than that necessary for an output at 29, the counter produces an output 36. This goes through OR-gate 31 to the output driver 32, and so triggers the remote alarm as before. The output of the converter 25 again excites the clock 33 which will be set to time out and generate the reset pulse after the output at 36. Thus,in this mode there is delayed detection of a constant input signal. Should it be interrupted within a given time the counter 28 will be reset before it has accumulated sufficient pulses to produce an output at 36, and so there would be no alarm.

In a third mode of operation (which could be combined with the second), the terminal 6 is left on open circuit to create a double knock facility. This means that the first impact producing vibrations in the crystal does not get through to trigger the alarm, but the system is primed so that the second and succeeding ones do so.

The first knock produces a signal from the amplifier 24 which goes to the level detector, as before, but by virtue of the pin 6, this does not then pass on the signal to the AND-gate 27, however large the input. But that signal, of whatever size, is still transformed into a pulse train by the converter 25 and fed to the clock 33. After an interval, that sends a reset signal to the level detector 26, effectively nullifying the pin 6. A second knock, occuring after this reset, will therefore open the AND-gate 27 if of sufficient strength. The counter will then produce an output to trigger the alarm, as in the first or second mode of operation.

The output driver 32 will normally be set and arranged to produce an output current, derived from the regulator 21, which will hold a relay energised in the non-alarm mode. An input through the OR-gate 31 cuts this off and causes the relay to de-energise. The same effect is generated if the supply to the chip at pin 9 fails or is cut, which is a recommended safety feature. However, in some circumstances, it may be acceptable to have the reverse arrangement, that it the relay is de-energised in the non-alarm mode and an input signal to the driver 32 causes a current to flow. This alternative may be selected simply by shorting pin 11 to earth.

Once triggered the output driver 32 will continue to activate the alarm until reset, even though there is no longer a signal from the sensor. The driver 32 can be reset in various ways through the OR-gate 35, one of them being by the clock 33 through the AND-gate 34, as mentioned above. The other input of this gate is from pin 7, which may be linked to earth or taken to high. When high, the AND-gate 34 is permanently closed and there can be no resetting of the driver 32 through it. Thus the alarm would be latched on. But on shorting the pin 7 to earth, the delayed output of the clock would pass through to the OR-gate 35 and thence reset the output driver 32. Thus, the alarm will be cut off at the end of the clock period.

Another way of resetting the driver 32 is turning on the power supply at the pin 9. The positive leading edge is translated by the circuit 22 into a resetting pulse which passes through the OR-gate 35 to the output driver 32. Thus, if the alarm has been triggered by a break in the power supply to the chip, restoration automatically cuts the alarm off again.

A third reset arrangement is provided by the pin 14, to which a signal can be applied from a remote station, generally a central control panel. The change of state detector 37 then generates a reset pulse which is applied to the OR-gate 35, and then to the driver 32. The detector 37 would conveniently have a short delay of half a second, for example, in order to enhance noise immunity. While it would be possible to dispense with the detector 37 and send a reset pulse direct, it is provided to interface with different control panels.

The integrated circuit also embodies first up alarm and memory logic 38. Its basic function is to receive any signal from the OR-gate 31 and, whenever this occurs, to provide a steady input to AND-gate 39 whose other inputs are from a flasher unit 40 and the pin 15, which is normally earthed. When the alarm is triggered, this gate 39 is opened by the logic 38 and a pulsed input is applied to the LED regulator 41 from the flasher unit 40, the period being half a second, say. The LED connected to the pin 10 consequently flashes at that rate.

It is sometimes required to hold off the illumination of the LED until instructed by a remote control signal. In this case, the pin 15 is no longer earthed, but is normally held positive by the remote control signal. When this is reduced to zero, then the AND-gate 39 will be opened and the LED will flash, assuming the other necessary inputs are applied.

The circuit also offers the facility of indicating whether it is the first among a group of interconnected ones to be triggered. When this facility is not required the pin 13 is left uncommitted and the logic 38 operates the LED as described. However, when it is wanted, all the pins 13 of the group are mutually interconnected or commoned and are held positive through an end-of-line resistor to the supply. There is an input protection circuit 42 between each pin 13 and the logic 38, and a pull-down switch 43 which receives an input from the logic 38 whenever there is a local alarm signal.

The first detector to operate will cause its own LED to flash, as described. At the same time, the switch 43 is activated to pull down the common node or pins 13. The other detectors will have this change of state signalled to their respective logics 38. Any one of these other detectors then being operated, its logic 38 would send a constant signal directly to the LED regulator 41, which would cause its LED to have steady illumination. Thus the flashing LED indicates the first disturbed detector unit and any steady ones represent subsequently disturbed units.

I claim:

1. An alarm system in which an intruder-generated disturbance is signalled by a detector station as an alarm signal to a remote station, the detector station comprising a level detector (26) to which a disturbance signal is applied, means (25) for forming said disturbance signal into a pulse train, a clock (33) to which the pulse train is applied, and means (27) for gating said pulse train through when the disturbance signal has attained a predetermined level and when a set time after the clock has registered a pulse train has elapsed, whereby a further disturbance signal, if attaining said predetermined level, opens the gating means, characterised in that a counter (28) receives the pulse train from the gating means and provides an alarm signal trigger (29) only after a given number of pulses, the clock (33) being arranged to reset the counter (28) after said set time.

2. A system as claimed in claim 1, characterised in that there are means (6) normally holding the level detector (26) in a state such that its output closes the gating means (27) but which is nullified after said set time.

3. A system as claimed in claim 1, characterised in that there are selectable means (8, 30) for blocking the alarm signal trigger, the counter (28) being arranged to deliver an alternative alarm signal trigger after a greater given number of pulses, thereby to generate a substantially delayed alarm.

4. A system as claimed in claim 1, characterised in that alarm generating means (32) activatable by the alarm signal trigger (29) has an associated selectable re-set facility (7, 34) in one mode of which the clock (33) output is arranged to re-set the alarm generating means after each said set time.

5. A system as claimed in claim 4, characterised in that alarm generating means (32) activatable by the alarm signal trigger has an associated re-set facility (14, 37) adapted to respond to a change of state on a remote control line thereto, subject to delay whereby transient signals are suppressed.

6. A system as claimed in claim 4, characterised in that a selectable re-set facility for the alarm generating means (32) is provided by means (22) responsive to the supply or restoration of power to the detector.

* * * * *